US009777531B1

(12) United States Patent
Conklin

(10) Patent No.: US 9,777,531 B1
(45) Date of Patent: Oct. 3, 2017

(54) LOAD BEARING SPACER FOR SKYLIGHT INSTALLATIONS

(71) Applicant: Wayne Conklin, Butler, NJ (US)

(72) Inventor: Wayne Conklin, Butler, NJ (US)

( * ) Notice: Subject to any disclaimer, the term of this patent is extended or adjusted under 35 U.S.C. 154(b) by 83 days.

(21) Appl. No.: 14/839,388

(22) Filed: Aug. 28, 2015

(51) Int. Cl.

| | |
|---|---|
| ***E06B 3/663*** | (2006.01) |
| ***E06B 3/67*** | (2006.01) |
| ***E04B 7/18*** | (2006.01) |
| ***E04D 13/03*** | (2006.01) |
| ***E06B 3/66*** | (2006.01) |

(52) U.S. Cl.
CPC ..... *E06B 3/66304* (2013.01); *E04B 7/18* (2013.01); *E04D 13/03* (2013.01); *E06B 3/66* (2013.01); *E06B 3/663* (2013.01); *E06B 3/6715* (2013.01)

(58) Field of Classification Search
CPC . E04D 13/03; E04D 13/0315; E04D 13/0325; E04B 7/18; E06B 3/66304; E06B 3/6715; E06B 3/66352; E06B 3/33361; E06B 3/66385; E06B 3/66; E06B 3/663; E06B 3/66314
USPC ..... 52/786.13, 200, 656.9, 172
See application file for complete search history.

(56) References Cited

U.S. PATENT DOCUMENTS 2,193,393 A 3/1940 Danner
2,618,819 A 11/1952 Goodwillie
2,877,515 A * 3/1959 Haas ..... E06B 3/26301 52/172
4,055,031 A * 10/1977 Okawa ..... E06B 3/64 428/34
4,074,480 A 2/1978 Burton
4,222,213 A 9/1980 Kessler
4,294,649 A 10/1981 Sarka
4,411,115 A * 10/1983 Marzouki ..... E06B 3/667 52/204.593
4,431,691 A 2/1984 Greenlee
4,453,855 A * 6/1984 Richter ..... E06B 3/667 403/295
4,459,789 A * 7/1984 Ford ..... E06B 3/24 52/171.3
4,479,988 A 10/1984 Dawson
4,520,602 A 6/1985 Miller
(Continued)

FOREIGN PATENT DOCUMENTS

AU B4022989 3/1990
AU B5464990 11/1990
(Continued)

*Primary Examiner* — Joshua J Michener
*Assistant Examiner* — Matthew Gitlin
(74) *Attorney, Agent, or Firm* — Goldstein Law Offices, P.C.

(57) ABSTRACT

A spacer member, for allowing a walkable skylight with an insulating glass unit to be created with a structural glass panel and a thermal glass panel. The spacer member includes a slab part and a tube part having substantially the same thickness. The tube part is hollow, containing desiccant material for absorbing moisture within the insulating glass unit. The spacer members may be joined together to create a spacer frame. The spacer frame defines an inner rectangular region. When the spacer frame is sealed between the structural glass panels and the thermal glass panel, an air gap is created within the inner rectangular region. The desiccant material effectively removes moisture from air within the air gap.

5 Claims, 6 Drawing Sheets

(56) References Cited

U.S. PATENT DOCUMENTS 4,576,841 A * 3/1986 Lingemann ..... E06B 3/677 428/138
4,652,472 A * 3/1987 Davies ..... E06B 3/6604 428/136
4,850,175 A * 7/1989 Berdan ..... E06B 3/6604 428/34
4,942,704 A * 7/1990 King ..... E06B 3/677 428/34
4,994,309 A 2/1991 Reichert et al.
4,999,964 A 3/1991 Taylor
5,003,744 A 4/1991 Taylor
5,042,210 A 8/1991 Taylor
5,087,489 A 2/1992 Lingemann
5,088,258 A 2/1992 Schield et al.
5,094,055 A * 3/1992 Berdan ..... E06B 3/66314 428/34
5,207,036 A 5/1993 Sampson et al.
5,218,806 A 6/1993 Taylor
5,290,611 A * 3/1994 Taylor ..... E06B 3/66319 428/137
5,377,473 A * 1/1995 Narayan ..... E06B 3/66314 52/172
5,424,111 A 6/1995 Farbstein
5,436,040 A * 7/1995 Lafond ..... E06B 3/66328 428/192
5,487,937 A * 1/1996 Newby ..... B29C 47/021 428/167
5,630,306 A * 5/1997 Wylie ..... E06B 3/66314 29/897.3
5,713,177 A * 2/1998 Peterson ..... E06B 3/67304 52/204.591
5,890,289 A * 4/1999 Guillemet ..... B29C 47/0023 264/171.14
6,061,994 A * 5/2000 Goer ..... E06B 3/66319 52/172
6,192,652 B1 * 2/2001 Goer ..... E06B 3/66319 52/204.6
6,260,255 B1 * 7/2001 Richardson ..... A47F 3/0434 29/458
6,401,428 B1 * 6/2002 Glover ..... E06B 3/24 52/786.1
6,463,706 B1 * 10/2002 Guhl ..... C03C 27/06 428/34
6,737,129 B2 * 5/2004 Bayer ..... E06B 3/66342 428/34
6,823,644 B1 * 11/2004 Peterson ..... E06B 3/66314 52/172
6,889,480 B2 * 5/2005 Guhl ..... C03C 27/06 52/204.6
6,989,188 B2 * 1/2006 Brunnhofer ..... E06B 3/66319 428/188
7,713,600 B2 * 5/2010 Lisec ..... E06B 3/66328 156/109
7,827,761 B2 * 11/2010 Buchanan ..... E06B 3/24 52/786.13
8,209,922 B2 * 7/2012 Petersen ..... E06B 1/38 428/34
8,225,561 B2 7/2012 Voegele, Jr. et al.
8,281,527 B2 * 10/2012 Baratuci ..... E06B 3/66314 52/204.58
8,291,674 B2 10/2012 Valentz et al.
8,381,490 B2 2/2013 Back et al.
8,397,468 B2 3/2013 Mcclure
8,701,362 B2 4/2014 Stone
8,776,350 B2 * 7/2014 Cooper ..... E06B 3/66314 29/17.1
9,440,662 B2 * 9/2016 Kamaka ..... B61D 25/00
2004/0118082 A1 * 6/2004 Paci ..... E06B 3/66314 52/786.13
2006/0272232 A1 12/2006 Fooks
2007/0245646 A1 * 10/2007 Saito ..... C03C 27/10 52/172
2009/0110866 A1 4/2009 Ainz et al.
2014/0109499 A1 4/2014 Nieminen et al.
2014/0356557 A1 * 12/2014 Reichert ..... E06B 3/6604 428/34

FOREIGN PATENT DOCUMENTS

| | | |
|---|---|---|
| CA | 2015714 | 11/1990 |
| CA | 1328970 | 5/1994 |
| EP | 0356374 | 2/1990 |
| EP | 0396075 | 11/1990 |
| GR | 3017183 | 11/1995 |
| IE | 62450 | 2/1995 |
| IE | 67796 | 5/1996 |
| MX | 165468 | 11/1992 |
| MX | 172717 | 1/1994 |
| NZ | 230417 | 3/1993 |
| WO | WO2004042164 | 5/2004 |
| WO | WO2005019561 | 3/2005 |
| WO | WO2007011561 | 1/2007 |
| WO | WO2009056186 | 5/2009 |
| WO | WO2012041325 | 4/2012 |
| WO | WO2014066385 | 5/2014 |

* cited by examiner

LOAD BEARING SPACER FOR SKYLIGHT INSTALLATIONS

TECHNICAL FIELD

The present disclosure relates generally to a load bearing glass spacer. More particularly, the present disclosure relates to a spacer that is configured for supporting heavy structural glass panels upon a thermal panel in a walkable skylight assembly and thereby creating an insulating glass unit (IGU).

BACKGROUND

Skylights have traditionally been used to provide additional illumination through standard roofing structures. Generally they were not intended, and thus not designed, to support the weight of one or more persons walking upon them.

Over the past several decades, nearly all new windows in residential and commercial buildings have more than one pane of glass and some type of thermally insulative structure or insulating glass unit (IGU). Typically they involve panes of glass separated by a thermal break spacer and sometimes involve evacuating the space in between or filling it with a noble gas such as argon or krypton. As these structures are typically not load bearing, the materials used to fabricate such structures are generally lightweight and can be produced off-site in a manufacturing facility. In particular, the spacer typically used consists of a tubular structure, made of thin metal, and often containing a desiccant material for absorbing moisture present in the air between the glass panels.

Modern trends in building design often desire making rooftop surfaces into useable and even public spaces. This goal has made "walkable" skylights part of more and more building designs.

Walkable skylights must be designed to support the additional loading potential of numerous people walking and standing upon them. Accordingly, typically several layers of thick glass are employed.

Unfortunately, multiple panels of thick heavy glass, and the weight of people walking thereupon, can be too much for the flimsy spacers currently available. It is inevitable that they will ultimately fail. Thus, because of the limitations in the glass spacers currently available, while architects desire the aesthetics and functionality of walkable skylight units, such aspirations must compete with the goal of creating an energy efficient building.

While these units may be suitable for the particular purpose employed, or for general use, they would not be as suitable for the purposes of the present disclosure as disclosed hereafter.

In the present disclosure, where a document, act or item of knowledge is referred to or discussed, this reference or discussion is not an admission that the document, act or item of knowledge or any combination thereof was at the priority date, publicly available, known to the public, part of common general knowledge or otherwise constitutes prior art under the applicable statutory provisions; or is known to be relevant to an attempt to solve any problem with which the present disclosure is concerned.

While certain aspects of conventional technologies have been discussed to facilitate the present disclosure, no technical aspects are disclaimed and it is contemplated that the claims may encompass one or more of the conventional technical aspects discussed herein.

BRIEF SUMMARY

An aspect of an example embodiment in the present disclosure is to provide a skylight system that is walkable and energy efficient. Accordingly, the present disclosure provides a spacer that is capable of supporting heavy duty, load bearing structural glass panels upon a thermal panel, and creating an insulating glass unit therewith.

It is another aspect of an example embodiment in the present disclosure to provide a spacer that allows a sealed insulating glass unit to be created while preventing fogging and condensation. Accordingly, the spacer includes a tube hollow that contains desiccant material, the tube hollow in communication with the air gap created within the insulating glass unit.

It is yet another aspect of an example embodiment in the present disclosure to provide a spacer that will not fail, even when supporting heavy structural glass panels. Accordingly, the spacer has a slab part which is substantially solid and thus has superior compressive strength. Adjacent to the slab is a tube part which is substantially the same thickness as the slab part and contains the desiccant for absorbing moisture within the insulating glass unit. The slab part effectively prevents the tube part from being crushed under the weight of the structural glass panels.

Accordingly, the present disclosure describes a spacer member, for allowing a walkable skylight with an insulating glass unit to be created with a structural glass panel and a thermal glass panel. The spacer member includes a slab part and a tube part having substantially the same thickness. The tube part is hollow, containing desiccant material for absorbing moisture within the insulating glass unit. The spacer members may be joined together to create a spacer frame. The spacer frame defines an inner rectangular region. When the spacer frame is sealed between the structural glass panels and the thermal glass panel, an air gap is created within the inner rectangular region. The desiccant material effectively removes moisture from air within the air gap.

The present disclosure addresses at least one of the foregoing disadvantages. However, it is contemplated that the present disclosure may prove useful in addressing other problems and deficiencies in a number of technical areas. Therefore, the claims should not necessarily be construed as limited to addressing any of the particular problems or deficiencies discussed hereinabove. To the accomplishment of the above, this disclosure may be embodied in the form illustrated in the accompanying drawings. Attention is called to the fact, however, that the drawings are illustrative only. Variations are contemplated as being part of the disclosure.

BRIEF DESCRIPTION OF THE DRAWINGS

In the drawings, like elements are depicted by like reference numerals. The drawings are briefly described as follows.

The present disclosure now will be described more fully hereinafter with reference to the accompanying drawings, which show various example embodiments. However, the present disclosure may be embodied in many different forms and should not be construed as limited to the example embodiments set forth herein. Rather, these example embodiments are provided so that the present disclosure is thorough, complete and fully conveys the scope of the present disclosure to those skilled in the art.

DETAILED DESCRIPTION OF THE PREFERRED EMBODIMENTS

Figure 1:
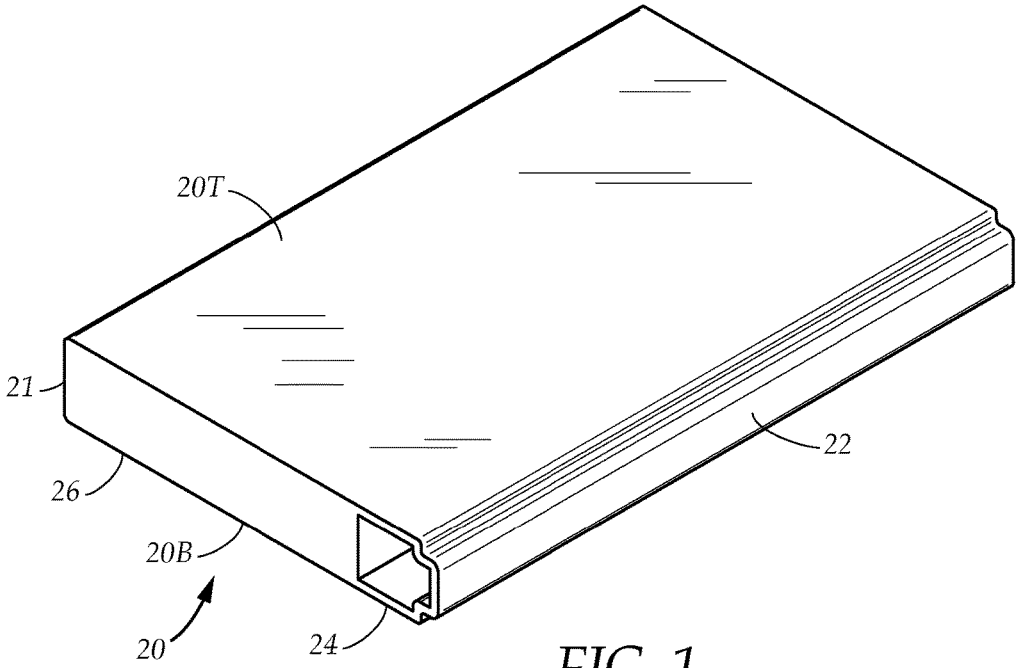
FIG. 1 is diagrammatic perspective view, showing a load bearing spacer member according to the present disclosure.

FIG. 1 illustrates a spacer member 20. The spacer member 20 has a top surface 20T, a bottom surface 20B, an inner edge 21, and an outer edge 22. The spacer member 20 further includes a tube part 24 and a slab part 26. The tube part has the outer edge 22, and the slab part 26 has the inner edge 21.

In accordance with principles of the present invention, the slab part 26 is substantially solid. "Substantially solid", as defined herein means that it is solid in ways that allow it to be considered a solid structure when assessing its properties in making calculations for loading. As an example of this concept, in conventional wood frame construction, 2×4 studs are often used for both load bearing and non-load bearing walls. In either case, holes are often drilled through the studs by plumbers and electricians to run pipes and wires. This practice is acceptable since such periodically spaced holes are not considered by structural engineers to significantly affect the structural integrity, and thus make the 2×4s no less solid than if such holes were present. Accordingly, here, where holes and openings in the slab part 26 might be periodically present as described hereinbelow, the slab part 26 can nonetheless be considered solid for the purposes of calculating loading characteristics, and thus herein will be referred to as "substantially solid". Said differently, "substantially solid" herein can be considered as solid, yet having periodic holes or channels.

Figure 2:
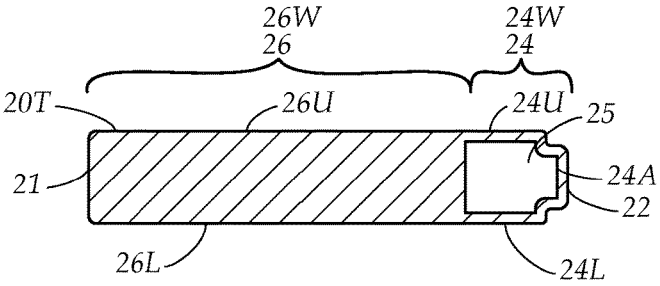
FIG. 2 is a cross sectional view, showing the spacer of FIG. 1.

Referring to FIG. 2, the slab part 26 has an upper edge 26U and a lower edge 24L. The tube 24 includes an upper wall 24U, a lower wall 24L, and a tube outer wall 24A. The upper wall 24U and lower wall 24L of the tube 24 adjoin the slab part 26, such that the upper wall 24U continues into the slab 26 and is flush with the upper edge 26U, and the lower wall 24L continues into the slab 26 and is flush with the lower edge 26L. Accordingly, the slab part 26 has a slab thickness between the upper edge 26U and lower edge 24L. The tube 24 has a tube thickness between the upper wall 24U and lower wall 24L. The slab thickness and tube thickness are substantially the same, except immediately adjacent to the outer wall 24A where the tube part 24 gets narrower as will be discussed below. Accordingly, the spacer 20 has a substantially uniform thickness. Distinct between the tube 24 and slab part 26, however, is that the tube is hollow between the upper wall 24U and lower wall 24L, while the slab part 26 is substantially solid and elongated toward the inner edge 21. In particular, the tube 24 has a tube hollow 25, defined by the upper wall 24U, lower wall 24L, outer tube wall 24A, and the slab part 26.

The spacer member 20 has an overall width, which can be defined between its inner edge 21 and outer edge 22. The tube 24 has a tube width 24W, and the slab part 26 has a slab part width 26W which together add up to the overall width. Note that the slab width 26W is generally at least twice the tube width 24W and preferably more than three times, so that loading on the top surface 20T of the spacer member 20 is effectively carried by the slab part 26. As an example of a spacer 20 having suitable proportions for skylight installations, the spacer has an overall width of two and one sixteenth inches, with the slab portion width being one and five eighths inches (making the tube portion width seven sixteenths). In that example, the slab width is actually about 3.7 times the tube width. Note that spacer in this example has an overall thickness of thirteen thirty-seconds of an inch.

Still referring to FIG. 2, tube 24 has an irregular shape near the tube outer wall 24A to allow sealants, such as clear structural silicone, to effectively bond to the spacer member 20 and maintain position. This irregular shape accounts for the only exception to the uniform thickness of the spacer member 20 and may vary depending on the types of sealants used.

Figure 6:
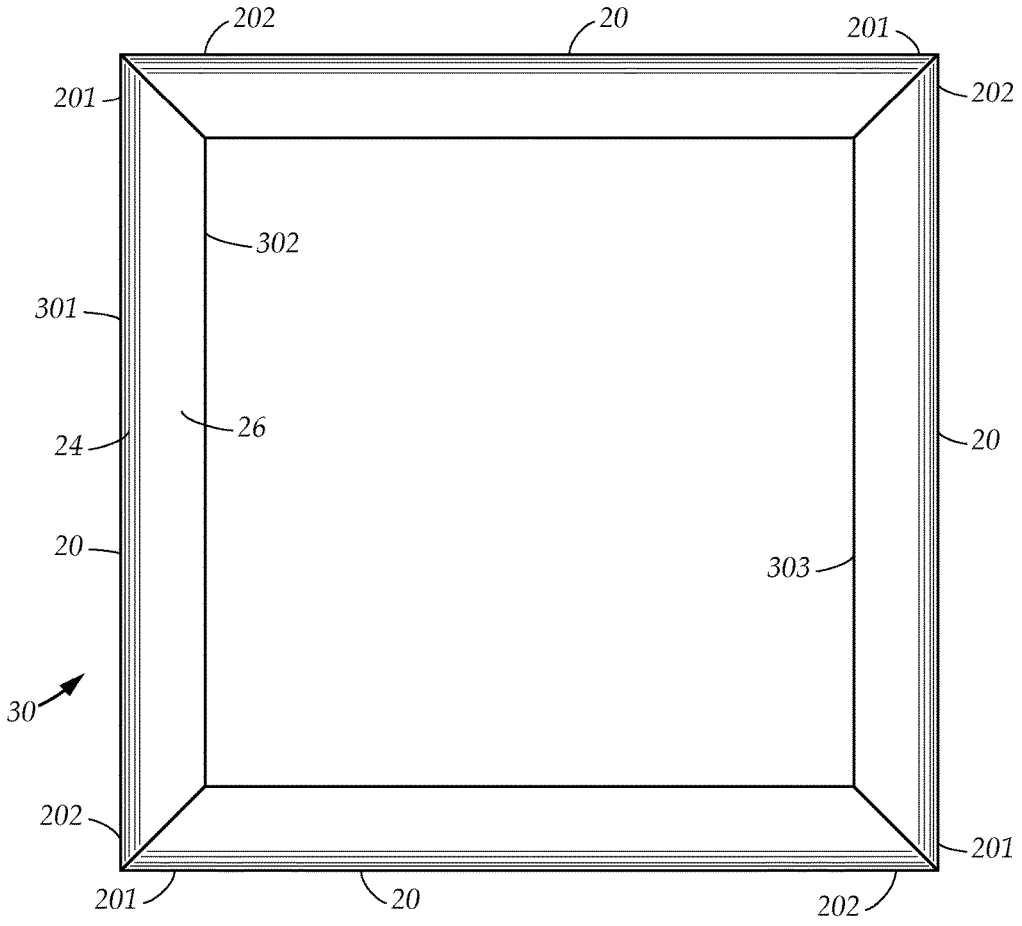
FIG. 6 is a top plan view, illustrating four spacer members assembled into a spacer frame.

Referring now to FIG. 6, generally four spacer members 20 are joined together at ninety degree angles into a spacer frame 30. The spacer members 20 each have a first end 201 and a second end 202. The first end 201 of each spacer member 20 is joined to the second end 202 of another of the spacer members 20. The spacer members 20 are cut at their first and second ends 201, 202 at a forty five degree angle, so that they may be joined so that the spacer members 20 meet at a ninety degree angle. Note that the spacer frame 30 has a spacer frame outside edge 301 and a spacer frame inner edge 302. The slab part 26 of each spacer member 20 is located at the spacer frame inside edge 302, and the tube part 24 is located at the spacer frame outside edge 301. The inner edges 302 of the spacer frame 30 define an inner rectangular region 303, where air is contained upon use of the space frame 30 within an insulating glass unit.

Figure 3:
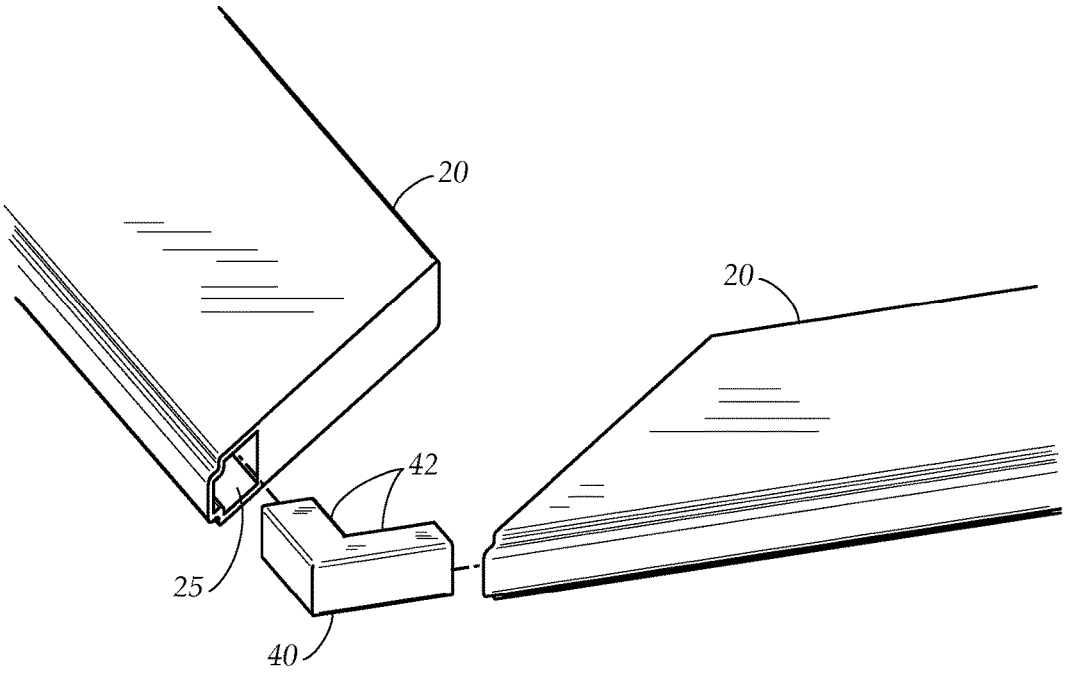
FIG. 3 is a diagrammatic perspective view, providing an example of interconnecting two load bearing spacer members.

Now referring to FIG. 3, a preferred manner of attaching the spacer members 20 is illustrated. In particular, a right angle connector 40 is used that has two pegs 42, each sized to fit snugly inside the tube hollow 25, which meet at right angles. Each of the pegs 42 is inserted into the tube hollow 25 of the spacer members 20 to be joined, as the spacer members 20 are pushed toward each other. Joining four spacer members 20 in this manner will form the spacer frame 30 shown in FIG. 6.

Figure 4:
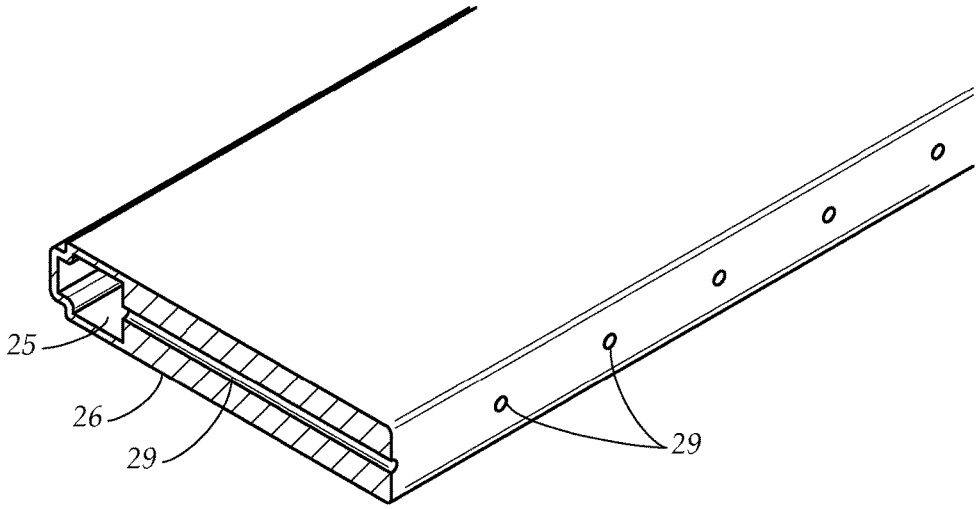
FIG. 4 is a diagrammatic perspective view with parts broken away, illustrating an embodiment of the spacer member with venting channels.
Figure 5:
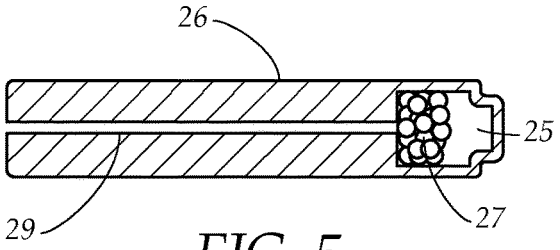
FIG. 5 is a cross sectional view, illustrating the venting channels providing gaseous communication from the inner edge of the spacer member to the tube hollow.

As illustrated in FIG. 5, and removed in other drawing figures for clarity, the tube hollow 25 is filled with desiccant material 27. The desiccant material 27 is provided to absorb moisture within air trapped between glass panels where the spacer member 20 is used. Provision is made in the spacer member to allow the air to reach the tube hollow 25, and thus the desiccant material 27 contained therein. It is likely that minute cracks and openings that will inevitably be present where the spacer members 20 are joined together to create the frame will be sufficient to allow moisture in the air between the glass panels to find the desiccant material 27. In addition, referring to FIG. 4 and FIG. 5, vent channels 29 may be provided through the slab part 26, extending from the inner edge 21 to the tube hollow 25. Note that the desiccant material 27 is often provided in granular form, perhaps as miniature spheres. Accordingly, the vent channels 29 must be smaller in diameter than such spheres, so that air may be effectively communicated to the hollow 25 through the vent channels 29 without permitting the desiccant material to escape therethrough.

Figure 7:
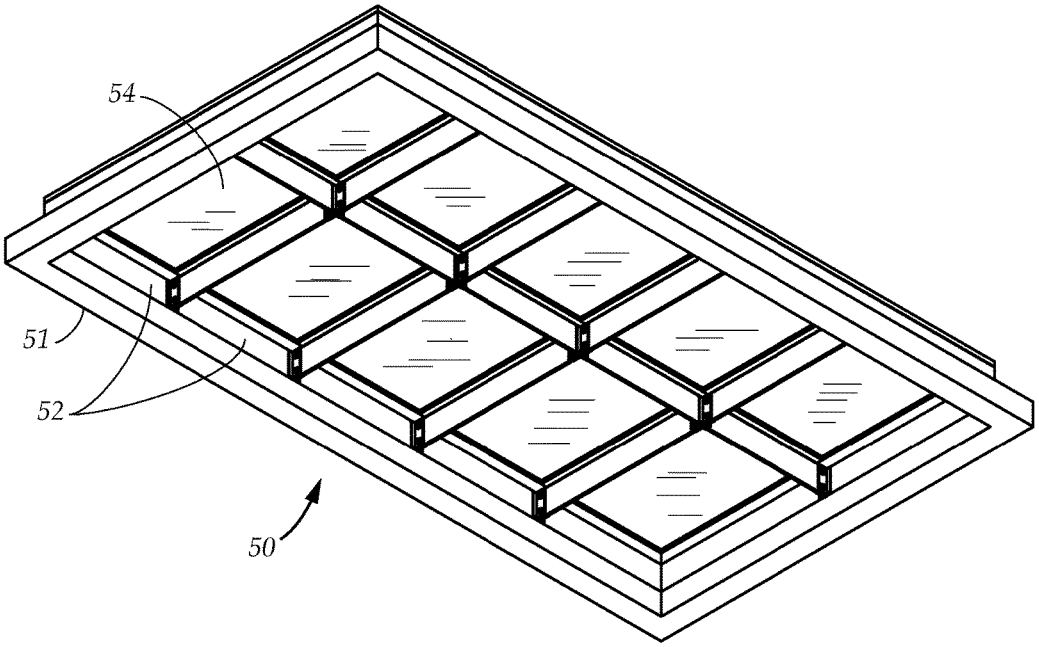
FIG. 7 is a diagrammatic perspective view, illustrating a skylight assembly, employing the load bearing spacer in accordance with principles of the present disclosure.

Referring to FIG. 7, a skylight assembly 50 is illustrated having a frame 51 that includes framing members 52, which delineate, define, and support several panes 54, each pane including several parallel glass panels and will be described further hereinbelow.

Figure 8:
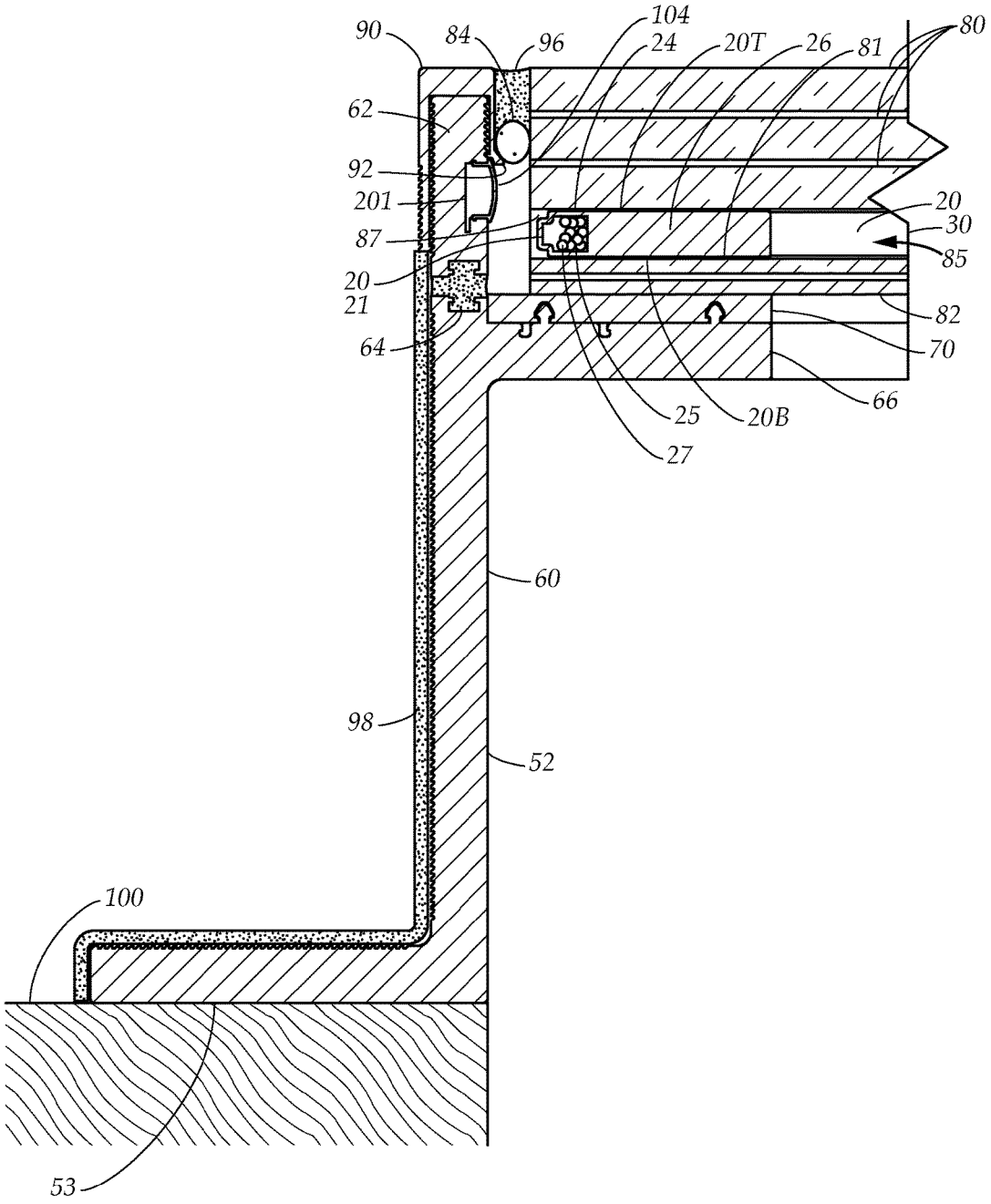
FIG. 8 is a cross sectional view, showing the load bearing spacer in use within a skylight assembly, supporting structural glass panels and creating an insulating glass unit with a thermal panel.

Referring to FIG. 8, the framing member 52 includes a vertical portion 60, an upper vertical portion 62, a mounting flange 53, and a thermal break 64 that connects the vertical portion 60 and upper vertical portion 62. The thermal break 64 is made of an insulating material, preferably a resin that is filled between extruded aluminum components for the vertical portion 60 and upper vertical portion 62. A support shelf 66 extends inwardly from the vertical portion 62 to support one of the panes 54. A glass setting block 70, made of a rubbery material, rests upon and is mated to the support shelf 66.

The pane is an insulating glass unit (IGU) that includes three heavy structural glass panels 80, and a thermal glass panel 82. Note that the thermal glass panel 82 may be constructed as two or more laminated sheets, such as the safety glass commonly used in automotive glass. The thermal glass panel 82 rests directly upon and is supported by the glass setting block 70. In accordance with the principles of the present disclosure, the structural glass panels 80 rest upon the top surface 20T of the spacer member 20 and is effectively supported thereby. The bottom surface 20B of the spacer member 20 rests upon the thermal glass panel 82. Note that for all intents and purposes it can be said that the structural glass panel 80 rests upon the spacer member 20 and that the spacer member 20 rests upon the thermal glass panel 82. However, a secondary sealant 81 is generally placed between the structural glass panel 80 and the spacer member 20, and between the spacer member 20 and the thermal glass panel 82. The secondary sealant effectively glues the structural glass panel 80 and thermal glass panel 82 to the spacer member 20. In addition, a primary sealant 87, extends between the structural glass panel 80, the thermal glass panel 82, and the outer edge 22 of the spacer member 20. The primary sealant 87 easily fills and adheres to spaces created by the irregular shape of the spacing member 20 at its outer edge 22.

Between the inner edge 21 of the spacer members 20 that form the spacer frame 30, the lowest of the structural glass panels 80, and the thermal glass panel 82 is an air gap 85. The desiccant 27 within the tube hollow 25 will effectively remove any moisture from the air gap 85 and prevent it from condensing on the glass panels 80, 82. In addition, the slab part 26 effectively supports the weight of the heavy, structural glass panels 80, and thereby prevents failure of the spacer 20 by preventing the tube 24 from being crushed under the weight of the glass panels. Thus, an insulating glass unit (IGU) is created, without sacrificing the strength and walkability of the structural glass, and without crushing the IGU under the weight of the structural glass and the load it is designed to support.

Additionally, note regarding the skylight installation illustrated—an adjustable cap 90 is provided atop the vertical portion 60. The adjustable cap 90 is repositionable to various heights, so as to provide an upper surface for the framing member 52 that is substantially flush with the pane 54. The adjustable cap 90 has a protruding foot 92 that extends toward the pane 54. The protruding foot 92 provides support for backer rod 84, generally made of foam or the like, that is extended in the space between the adjustable cap 90 and pane 54. A sealant 96, such as clear structural silicone, is filled in above the backer rod, between the adjustable cap 90 and structural glass panels 80 that form part of the pane 54.

The mounting flange 53 on the framing member 52 secures the framing member 52 to a building structure 100. Waterproofing and insulation material 98 extend on the framing member 52 on an opposite side from the pane 54, covering the mounting flange 53, the vertical portion 60, thermal break 64, and part of the upper vertical portion 62 below the adjustable cap 90. The framing member 52 may also have an edge lighting assembly, that includes an lighting channel 102, a translucent lighting lens 104 covering and extending into the lighting channel 102, and a lighting element extending within the lighting channel 102.

It is understood that when an element is referred hereinabove as being "on" another element, it can be directly on the other element or intervening elements may be present therebetween. In contrast, when an element is referred to as being "directly on" another element, there are no intervening elements present.

Moreover, any components or materials can be formed from a same, structurally continuous piece or separately fabricated and connected.

It is further understood that, although ordinal terms, such as, "first," "second," "third," are used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

Spatially relative terms, such as "beneath," "below," "lower," "above," "upper" and the like, are used herein for ease of description to describe one element or feature's relationship to another element(s) or feature(s) as illustrated in the figures. It is understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device can be otherwise oriented (rotated 90 degrees or at other orientations) and the spatially relative descriptors used herein interpreted accordingly.

Example embodiments are described herein with reference to cross section illustrations that are schematic illustrations of idealized embodiments. As such, variations from the shapes of the illustrations as a result, for example, of manufacturing techniques and/or tolerances, are to be expected. Thus, example embodiments described herein should not be construed as limited to the particular shapes of regions as illustrated herein, but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

In conclusion, herein is presented a load bearing spacer unit for a skylight system, configured to provide thermal insulation while also having the structural strength to be walkable. The disclosure is illustrated by example in the drawing figures and throughout the written description. It should be understood that numerous variations are possible while adhering to the inventive concept. Such variations are contemplated as being a part of the present disclosure.

What is claimed is:

1. An insulating glass unit, comprising:

A panel of structural glass having structural glass panel edges;

A panel of thermal glass having thermal glass panel edges;

a spacer frame, having four spacers joined at ninety degree angles, each spacer having a top surface, a bottom surface, an inner edge, and an outer edge, the spacer having a slab part, the slab part extending from the inner edge, having an upper edge that coincides with the top surface, a lower edge that coincides with the bottom surface, the slab part substantially solid between the upper edge and lower edge, the spacer also having a tube part, the tube part having an outer wall at the outer edge, the tube part having an upper wall that coincides with the top surface, a lower wall that coincides with the bottom surface, the tube part adjoining the slab part, the slab part elongated from the inner edge to the tube part, the tube part having a tube hollow between the upper wall, lower wall, and outer wall, each spacer also having desiccant material contained within the tube part for absorbing moisture in air adjacent to the inner edge, wherein the spacer frame is positioned upon the thermal glass panel near the thermal glass panel edge, and the structural glass panel is positioned upon the spacer frame near the structural glass panel edges, the structural glass panel substantially supported by the slab part; and an air gap between the thermal glass panel, structural glass panel, and spacer frame, the air gap substantially sealed by the spacer frame and containing air that is in communication with the desiccant material within the hollow tube.

2. The insulating glass unit as recited in claim 1, further comprising primary sealant between the spacer frame and structural glass panel and between the spacer frame and thermal glass panel, the primary sealant creating an air tight seal that isolates the air gap.

3. The insulating glass unit as recited in claim 2, wherein for each spacer member the slab part has a slab thickness, the tube part had a tube thickness between the top surface and bottom surface, wherein the tube thickness and slab thickness are the same.

4. The insulating glass unit as recited in claim 3, wherein for each spacer member the tube part has a tube part width, the slab part has a slab part width, and wherein the slab part width is at least twice the tube part width.

5. The insulating glass unit as recited in claim 4, wherein for each spacer member the slab part further has venting holes that extend from the inner edge to the tube hollow for communicating air from the inner edge to the desiccant material within the hollow.

* * * * *